US010630021B2

(12) United States Patent
Shiraishi et al.

(10) Patent No.: US 10,630,021 B2
(45) Date of Patent: Apr. 21, 2020

(54) WATERPROOF CONNECTOR AND WATERPROOF STRUCTURE OF DEVICE CASE

(71) Applicants: J.S.T. MFG. CO., LTD., Tokyo (JP); Mitsubishi Electric Corporation, Tokyo (JP)

(72) Inventors: Makoto Shiraishi, Miyoshi (JP); Hiroshi Yamada, Miyoshi (JP); Naoya Hashii, Tokyo (JP); Kohei Ando, Tokyo (JP)

(73) Assignees: J.S.T. MFG. CO., LTD., Tokyo (JP); MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/395,510

(22) Filed: Apr. 26, 2019

(65) Prior Publication Data

US 2019/0348797 A1 Nov. 14, 2019

(30) Foreign Application Priority Data

May 9, 2018 (JP) ..... 2018-090476

(51) Int. Cl.
*H01R 13/52* (2006.01)
*H01R 13/502* (2006.01)
(Continued)

(52) U.S. Cl.
CPC ..... *H01R 13/5219* (2013.01); *H01R 12/716* (2013.01); *H01R 13/502* (2013.01); *H01R 13/5202* (2013.01); *H01R 13/6315* (2013.01)

(58) Field of Classification Search
CPC ..... H01R 13/5219; H01R 13/5202
See application file for complete search history.

(56) References Cited

U.S. PATENT DOCUMENTS 6,113,424 A * 9/2000 Shinozaki ..... H01R 13/5202 439/556
7,341,484 B2 * 3/2008 Yamamoto ..... H01R 13/5202 439/271

(Continued)

FOREIGN PATENT DOCUMENTS

JP 2014150017 A 8/2014

*Primary Examiner* — Ross N Gushi
(74) *Attorney, Agent, or Firm* — Rabin & Berdo, P.C.

(57) ABSTRACT

A waterproof connector includes a contact, a housing, a seal member, and a cover member. An inserted portion of the housing is inserted in an insertion hole of a wall portion of a device case. The inserted portion includes an annular surface disposed flush to or with a step provided with respect to a surface of the wall portion. The seal member includes an annular first seal portion, fitted in an annular groove formed in the annular surface, and a covering portion, extending orthogonally from the first seal portion toward the surface side of the wall portion. The covering portion spanningly covers a first gap, which is a gap between an outer peripheral surface of the inserted portion and an inner peripheral surface of the insertion hole. The cover member is fixed to the wall portion across the covering portion. A second seal portion, providing sealing between the cover member and the surface of the wall portion, is formed by a portion of the covering portion that is sandwiched by the cover member and the front surface of the wall portion.

11 Claims, 9 Drawing Sheets

(51) Int. Cl.
*H01R 13/631* (2006.01)
*H01R 12/71* (2011.01)

(56) References Cited

U.S. PATENT DOCUMENTS 8,047,861 B2 * 11/2011 Ciriello ..... H01R 13/516 439/271
8,066,518 B2 * 11/2011 Homme ..... H01R 13/5202 439/78
8,167,634 B2 * 5/2012 Fujiwara ..... H01R 13/5202 439/271
8,449,323 B2 * 5/2013 Omae ..... H01R 13/5202 439/559
8,979,554 B2 * 3/2015 Yudate ..... H01R 13/5202 439/271
9,281,609 B2 * 3/2016 Suzuki ..... H01R 13/5202
9,337,564 B2 * 5/2016 Endo ..... H01R 13/60
9,343,941 B2 * 5/2016 Okamoto ..... H01R 13/5202
9,379,477 B2 * 6/2016 Endo ..... H01R 13/60
9,997,858 B2 * 6/2018 Mogi ..... H01R 9/223
9,997,974 B2 * 6/2018 Ishibashi ..... H02K 5/124
10,038,287 B2 * 7/2018 Yamada ..... H01R 24/66
10,062,986 B2 * 8/2018 Shibaya ..... H01R 12/724
10,116,093 B2 * 10/2018 Ishibashi ..... H02K 5/22
10,224,666 B2 * 3/2019 Aoshima ..... H01R 13/40
10,270,202 B2 * 4/2019 Bulovic ..... H05K 5/06
10,277,019 B2 * 4/2019 Kosuga ..... H02M 7/48
10,290,974 B2 * 5/2019 Ishibashi ..... H01R 13/621
10,326,233 B2 * 6/2019 Coenegracht ..... H05K 5/061
10,340,626 B2 * 7/2019 Kondo ..... F16B 39/01
10,367,292 B2 * 7/2019 Furuya ..... H01R 13/5202
10,396,486 B2 * 8/2019 de Chazal ..... H01R 13/4362
10,411,392 B2 * 9/2019 Manushi ..... H01R 13/5202
2010/0190375 A1 * 7/2010 Rohde ..... H01R 13/5202 439/549
2013/0171854 A1 * 7/2013 Homme ..... H01R 13/5202 439/272
2013/0242099 A1 * 9/2013 Sauer ..... H04N 5/2257 348/148
2013/0293771 A1 * 11/2013 Mori ..... H04N 5/2252 348/374
2015/0099385 A1 * 4/2015 Ikeya ..... H01R 12/724 439/271
2015/0099394 A1 * 4/2015 Ikeya ..... H01R 12/724 439/533
2016/0172784 A1 * 6/2016 Kataoka ..... H01R 13/5219 439/271
2016/0226347 A1 * 8/2016 Okamoto ..... H01R 13/5202
2019/0027871 A1 * 1/2019 Data ..... H01R 13/6592
2019/0044276 A1 * 2/2019 Maesoba ..... H01R 12/515
2019/0123479 A1 * 4/2019 Lim ..... H01R 13/5219
2019/0221959 A1 * 7/2019 Tsai ..... H01F 27/02
2019/0237899 A1 * 8/2019 Makino ..... H01R 13/5202
2019/0296485 A1 * 9/2019 Masuda ..... H01R 13/506
2019/0326704 A1 * 10/2019 Shinoda ..... H01R 13/405

* cited by examiner

WATERPROOF CONNECTOR AND WATERPROOF STRUCTURE OF DEVICE CASE

CROSS REFERENCE TO RELATED APPLICATION

This application claims the benefit of priority to Japanese Patent Application No. 2018-090476 filed on May 9, 2018. The entire contents of this application are hereby incorporated herein by reference.

BACKGROUND OF THE INVENTION

Field of the Invention

The present invention relates to a waterproof connector and a waterproof structure of a device case.

Description of Related Arts

For example, JP 2014-150017 A discloses a waterproof connector connected to a circuit board disposed inside a case. The waterproof connector includes a connector main body, a portion of which projects outside the case via a connector mounting hole formed in a cover panel of the case. A cover member arranged to install the connector main body on the cover panel is disposed along an outer periphery of the connector main body at a front side of the cover panel. The cover member is engaged to the cover panel via a back plate disposed at a rear side of the cover panel.

Also, the waterproof connector includes a first seal member, providing sealing between the cover member and the cover panel, and a second seal member, providing sealing between the connector main body and the cover member. The first seal member is held in an annular holding groove opening to the rear surface of the cover member and contacts a front surface of the cover panel. The second seal member is housed in an elastically compressed state in a gap between a holding portion, disposed at an inner periphery of the cover member, and an outer periphery of a base of a housing of the connector main body.

However, during assembly, a work of installing the two seal members of the first seal member and the second seal member is required and therefore ease of assembly is poor. Also, waterproofness may decrease when, due to influence of variations in installation positions of respective parts, such as the case, the circuit body, the connector main body, etc., a gap width of the gap, in which the second seal member is housed, changes.

SUMMARY OF THE INVENTION

An object of the present invention is to provide a waterproof connector and a waterproof structure of a device case that is satisfactory in ease of assembly and excellent in waterproofness.

In order to achieve the above object, a preferred mode of the present invention provides a waterproof connector, being a waterproof connector, mounted on a surface of a circuit board, which is fixed inside a device case that includes a wall portion with an insertion hole formed therein, and connected to a counterpart connector via the insertion hole in a connector connecting direction orthogonal to a surface of the wall portion, and including a contact electrically connected to the counterpart connector, an insulating housing including an inserted portion holding the contact and inserted in the insertion hole, the inserted portion including an annular surface disposed flush to or with a step provided with respect to the surface of the wall portion, an elastic seal member including an annular first seal portion fitted in an annular groove formed in either one of the annular surface of the inserted portion and the surface of the wall portion, and an annular covering portion extending orthogonally from the first seal portion toward the other one of the annular surface of the inserted portion and the surface of the wall portion and spanningly covering a gap between an outer peripheral surface of the inserted portion and an inner peripheral surface of the insertion hole and having a second seal portion, and a cover member fixed to the other one and sandwiching, together with the other one, the covering portion of the seal member, and where the second seal portion is formed by a portion of the covering portion of the seal member that is sandwiched by the cover member and the other one.

With the present mode, the seal member has the first seal portion and the second seal portion and therefore, in comparison to a case where the respective seal portions are constituted of separate members, a work of installing the seal member during assembly is easy and ease of assembly is satisfactory. Also, even if a gap width of the gap between the inner peripheral surface of the insertion hole and the outer peripheral surface of the inserted portion of the housing changes, this does not influence a sealing performance by the covering portion that spanningly covers the gap. Excellent waterproofness can thus be obtained.

Also, the cover member may be harder than the seal member and a single unit that includes the seal member and the cover member may be formed. In this case, the seal member and the cover member, which is harder than the seal member, can be handled integrally as the single unit. Therefore, during assembly, installation is facilitated and the ease of assembly is improved in comparison to a case where the seal member is installed as a single body.

Also, the cover member may include a main body portion coupled to the covering portion, and a holding portion extended from the main body portion and holding the first seal portion. In this case, the first seal portion of the seal member is held by the holding portion of the cover member in the unit. It is thus made easy to insert the first seal portion in the annular groove when installing the unit and the ease of assembly is more improved.

Also, a labyrinth gap may be formed between the seal member and the cover member. In this case, moisture, etc., from the exterior can be suppressed from entering through between the cover member and the seal member.

Also, an annular seal surface, facing the second seal portion, may be formed on the surface of the wall portion, the second seal portion may contact the seal surface to form an annular seal region, and when the gap width of the gap between the outer peripheral surface of the inserted portion and the inner peripheral surface of the insertion hole is S1, a seal width that is a radial direction width of the seal region of the second seal portion is S3, and a radial direction width of the seal surface is S4, such a relationship that $S1<(S4-S3)/2$ is established. In this case, even if a deviation of a relative position of the device case and the waterproof connector is large, excellent waterproofness can be secured regardless of deviation amount of the relative position.

Also, an insertion hole in which the inserted portion of the housing is inserted may be formed in the cover member, and an inner peripheral surface of the insertion hole of the cover member may be disposed further radially inward than an inner wall surface at a radially inner side of the annular groove which is provided in the housing and in which the first seal portion is fitted. In this case, the structure is such that the first seal portion is not wetted directly even when high pressure water is applied to the waterproof connector and therefore excellent waterproofness can be secured.

Also, on the surface of the wall portion, a boss portion having a flat seal surface facing the second seal portion, at an end surface, may be formed along a peripheral edge of the insertion hole of the wall portion, the cover member may include a rear surface facing the surface of the wall portion, and an annular outer flange projecting from the rear surface and surrounding a radial outer side of the boss portion, and when a distance from the surface of the wall portion to the seal surface is H1 and a distance from the surface of the wall portion to the outer flange is H2, such a relationship that H1>H2 is established.

In this case, the structure is such that the seal surface is not wetted directly even when high pressure water is applied to the waterproof connector and therefore excellent waterproofness can be secured. Also, if the wall portion is an aluminum die-cast component, the surface of the wall portion may corrode when it is wetted with salt water. On the other hand, with the present mode, the structure is such that salt water would not be applied directly to the flat seal surface. Also, the structure is such that the seal surface is positioned one step higher from the surface of the wall portion and salt water can be prevented from flowing into the seal surface side. Excellent salt water resistance can thus be secured.

Also, the annular groove may be formed in the annular surface of the housing, the outer peripheral surface of the inserted portion of the housing may include a first outer peripheral surface facing an inner peripheral surface of an insertion hole formed in the cover member across a gap with a gap width S2, a chamfered portion may be provided at least on one of either of an inner side and an outer side of a tip of the first seal portion, and when a width resulting from subtracting a chamfer width of the chamfered portion from a thickness width between an inner peripheral surface and an outer peripheral surface of the first seal portion is S5 and a width of the annular groove is S6, such a relationship that S2<(S6−S5)/2 is established.

In this case, when installing the unit, with which the cover member and the seal member are assembled together in advance, onto the connector and the device case, the inner peripheral surface of the insertion hole of the cover member is guided by the outer peripheral surface of the inserted portion of the waterproof connector. The first seal portion can thus be inserted in the annular groove in a state where the tip of the first seal portion is in alignment with the annular groove, thus improving ease of assembly and consequently enabling adaptation to automatic assembly and enabling reduction of assembly cost.

Also, the outer peripheral surface of the inserted portion of the housing may include a second outer peripheral surface, facing the inner peripheral surface of the insertion hole of the wall portion across a gap with a gap width S1, and when an outer diameter of a fixing screw arranged to fasten the cover member to the device case is S7 and a threaded hole diameter of a threaded hole, in which the fixing screw is inserted, is S8, such a relationship that S1<(S8−S7)/2 is established. In this case, even if the deviation of the relative position of the device case and the waterproof connector is large, excellent waterproofness can be secured regardless of the deviation amount of the relative position because the cover member and the seal member move.

Also, the annular groove may be formed in the front surface of the wall portion, the outer peripheral surface of the inserted portion of the housing may include a first outer peripheral surface facing an inner peripheral surface of an insertion hole formed in the cover member across a second gap, and a second outer peripheral surface facing the inner peripheral surface of the insertion hole of the wall portion across a first gap, and when a gap width of the first gap is S1 and a gap width of the second gap is S2, such a relationship that S1<S2 is established. In this case, even if the deviation of the relative position of the device case and the waterproof connector is large, excellent waterproofness can be secured regardless of the deviation amount of the relative position.

Also, another mode of the present invention provides a waterproof structure of a device case including the device case which includes a wall portion with an insertion hole formed therein and to which a circuit board is fixed, and the waterproof connector. With the present mode, a waterproof structure of a device case that is satisfactory in ease of assembly and has excellent waterproofness can be realized.

DETAILED DESCRIPTION OF THE PREFERRED EMBODIMENT

Preferred embodiments specifically embodying the present invention will now be described with reference to the drawings.

First Preferred Embodiment

Figure 1:
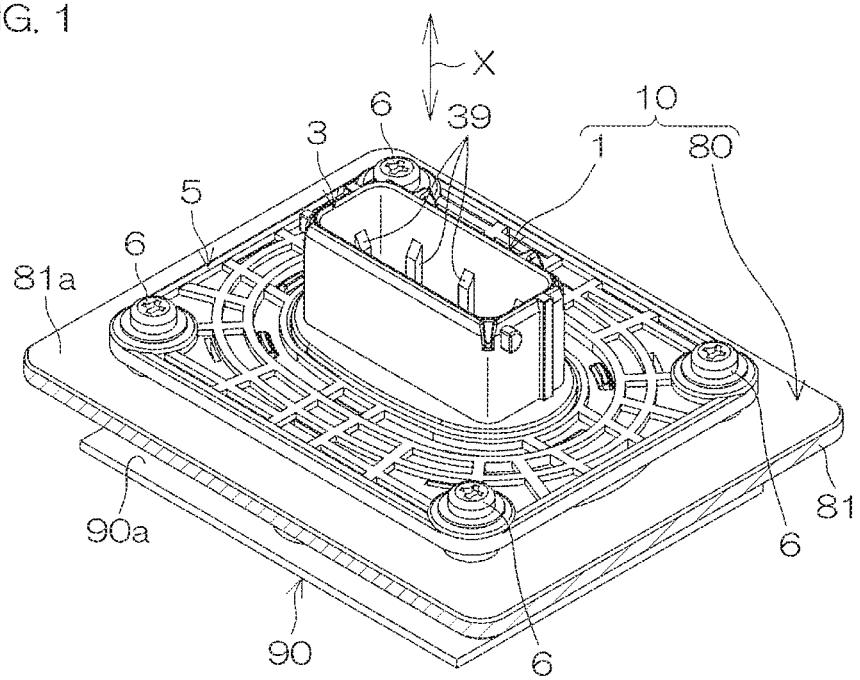
FIG. 1 is a partially broken-away perspective view of a waterproof structure of a device case that includes a waterproof connector according to a first preferred embodiment of the present invention.
Figure 2:
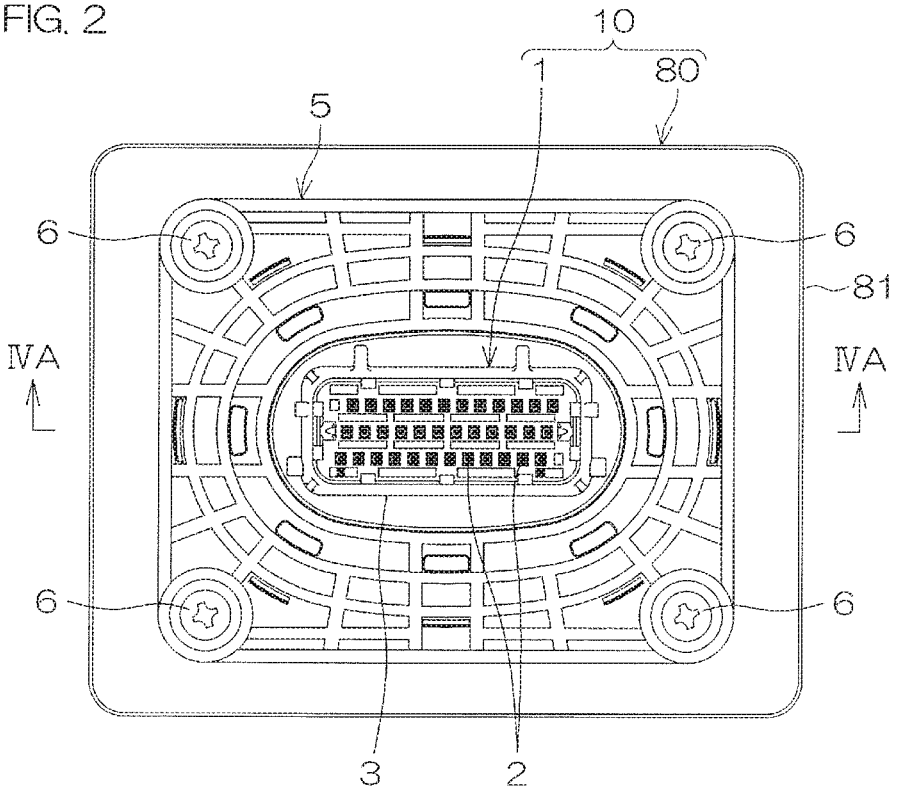
FIG. 2 is a plan view of the waterproof structure of the device case.
Figure 3:
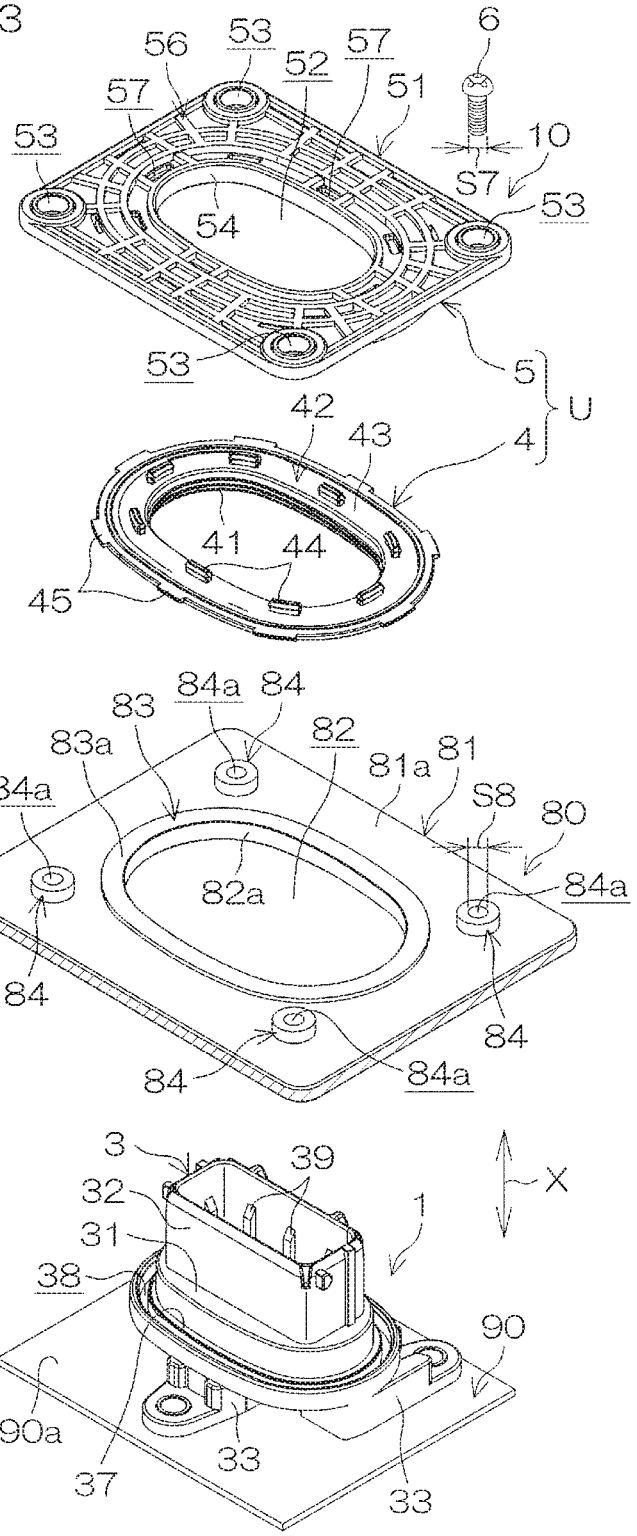
FIG. 3 is an exploded perspective view of the waterproof structure of the device case.
Figure 4A:
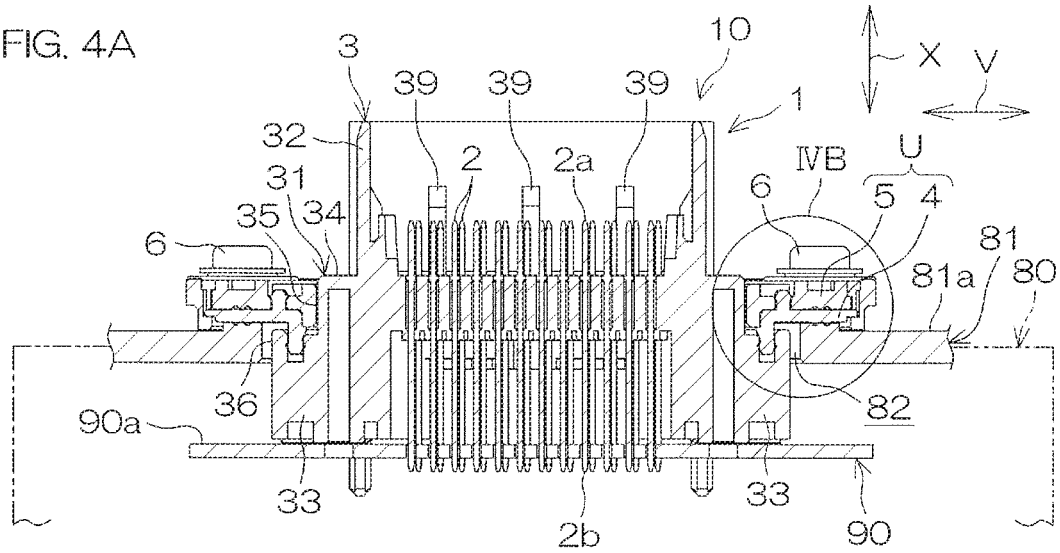
FIG. 4A is a general sectional view of the waterproof structure of the device case.

FIG. 1 is a partially broken-away perspective view of a waterproof structure 10 of a device case (may be referred to hereinafter simply as "waterproof structure 10") that includes a waterproof connector 1 according to a first preferred embodiment of the present invention. FIG. 2 is a plan view of the waterproof structure 10. FIG. 3 is an exploded perspective view of the waterproof structure 10. FIG. 4A is a general sectional view of the waterproof structure 10, and FIG. 4B is an enlarged sectional view enlarging an IVB portion of FIG. 4A.

As shown in FIG. 1, FIG. 2, FIG. 3, and FIG. 4, the waterproof structure 10 includes a device case 80, including a wall portion 81, and a waterproof connector 1 that is a male connector mounted on amounting surface 90*a* of a circuit board 90 fixed inside the device case 80. The waterproof connector 1 is connected in a connector connecting direction X to a counterpart connector (not shown) that is a female connector. A front surface 81*a* of the wall portion 81 of the device case 80 and the mounting surface 90*a* of the circuit board 90 are orthogonal to the connector connecting direction X.

Figure 4B:
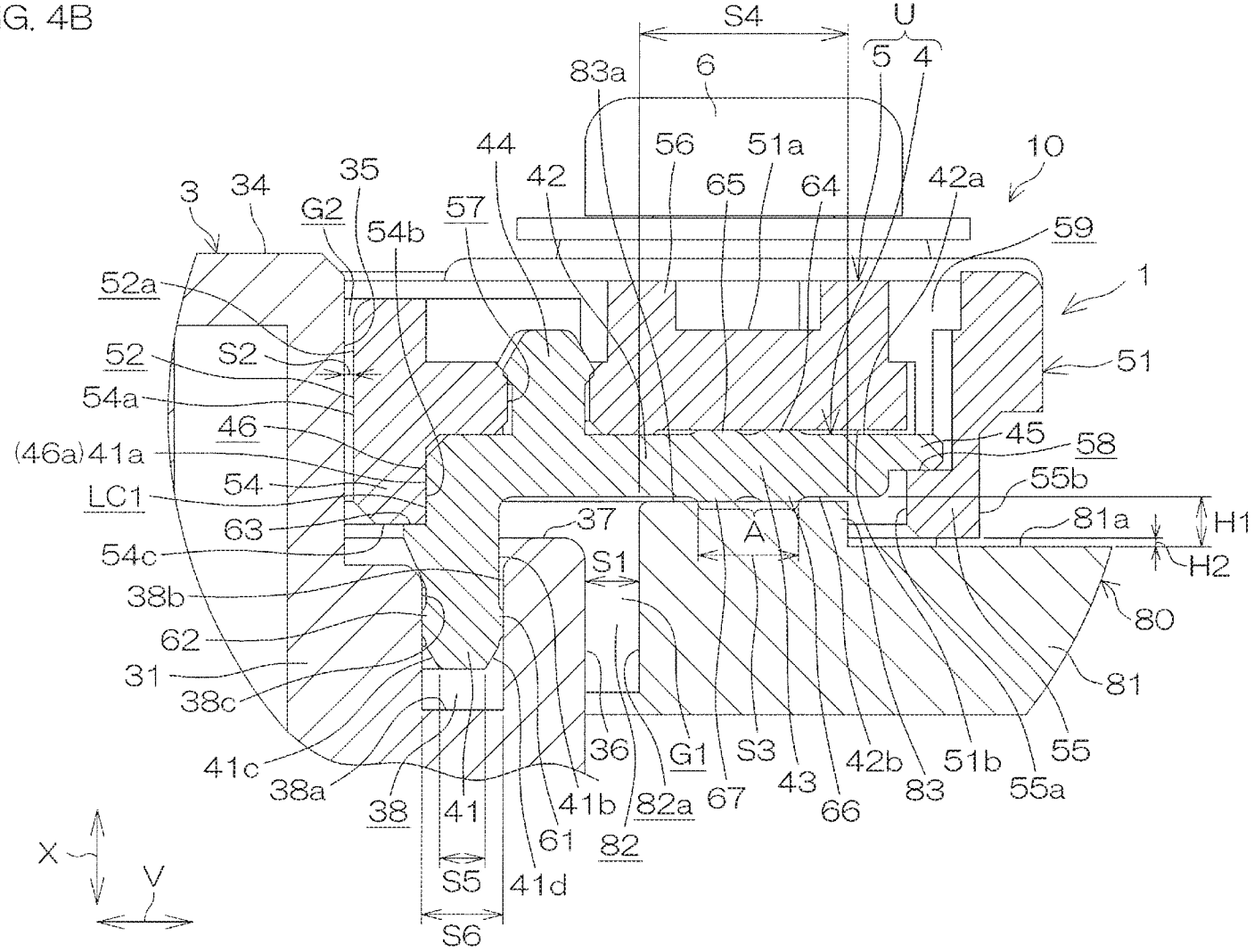
FIG. 4B is an enlarged sectional view enlarging an IVB portion of FIG. 4A.

As shown in FIG. 3 and FIG. 4B, an insertion hole 82 is formed in the wall portion 81 of the device case 80. On the front surface 81*a* of the wall portion 81, a boss portion 83, having a flat seal surface 83*a*, parallel to the front surface 81*a*, at an end surface, is formed along a peripheral edge of the insertion hole 82. Also as shown in FIG. 3, on the front surface 81*a* of the wall portion 81*a*, a plurality of threaded boss portions 84, each being of a circular cylindrical projection shape and having a threaded hole 84*a*, are disposed, for example, in quadrilateral annular shape so as to surround the insertion hole 82.

As shown in FIG. 3 and FIG. 4A, the waterproof connector 1 includes a plurality of contacts 2, connected in the connector connecting direction X to the counterpart connector, an insulating housing 3, holding the contacts 2 and fitted to the counterpart connector, an elastic seal member 4, and a cover member 5. The seal member 4 and the cover member 5 are formed as an integrally handleable single unit U. The cover member 5 is constituted of a material (for example, a resin or a metal) that is harder than the seal member 4.

Figure 5A:
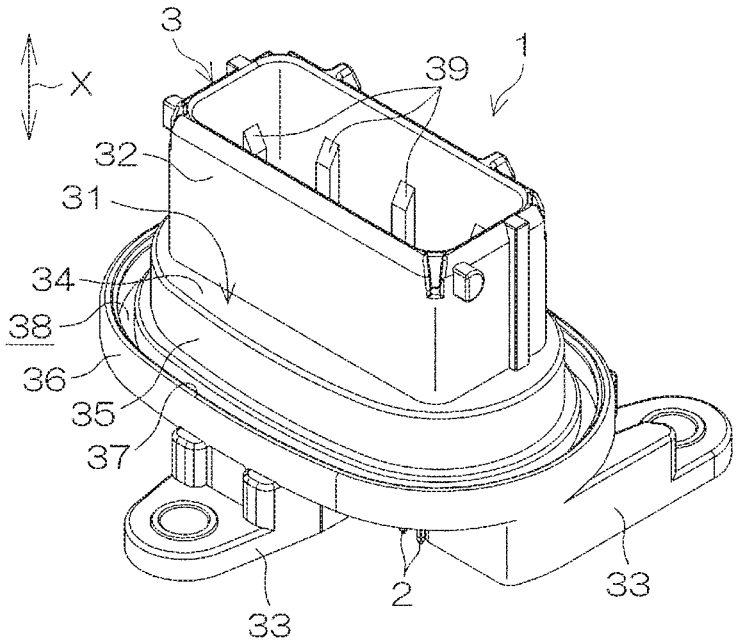
FIG. 5A is a perspective view of a housing that holds contacts.
Figure 5B:
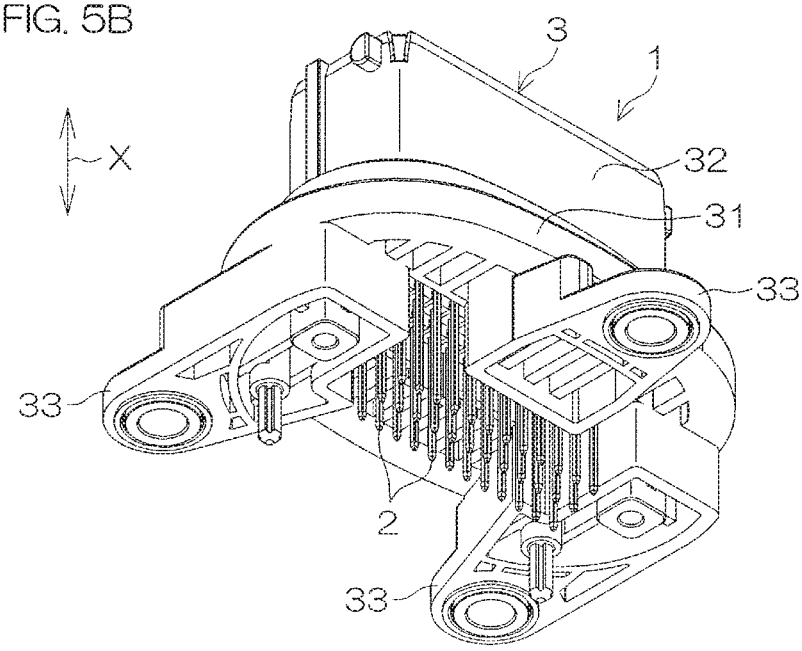
FIG. 5B is a perspective view of the housing from an angle differing from FIG. 5A.

Next, the housing 3 will now be described. FIGS. 5A and 5B are perspective views, viewed from mutually different angles, of the connector 1 in a state where the seal member 4 is removed. As shown in FIG. 4A and FIG. 4B and in FIG. 5A and FIG. 5B, the housing 3 includes a substantially plate-shaped supporting portion 31, supporting the contacts 2, a cylindrical portion 32, projecting from the supporting portion 31, a plurality of leg portions 33, projecting from the supporting portion 31 to an opposite side with respect to the cylindrical portion 32 and fixed to the mounting surface 90*a* of the circuit board 90*a*, and a plurality of ribs 39, projecting into the cylindrical portion 32 from the supporting portion 31.

The cylindrical portion 32 is formed to a substantially rectangular shape in a plan view. The supporting portion 31 is formed to an elliptical shape larger than an outline of the cylindrical portion 32 in a plan view. The supporting portion 31 is inserted into the insertion hole 82 of the wall portion 81 of the device case 80 and constitutes an inserted portion.

As shown in FIG. 4B and FIG. 5A, as the inserted portion, the supporting portion 31 includes an annular front surface 34 disposed further outward than the cylindrical portion 32, a first outer peripheral surface 35, intersecting the front surface 34, a second outer peripheral surface 36 of greater diameter than the first outer peripheral surface 35, and an annular surface 37 that is an annular step portion connecting the first outer peripheral surface 35 and the second outer peripheral surface 36.

As shown in FIG. 4B, the second outer peripheral surface 36 is inserted into the insertion hole 82 of the wall portion 81 of the device case 80. The second outer peripheral surface 36 of the supporting portion 31 faces an inner peripheral surface 82*a* of the insertion hole 82 of the wall portion 81 with there being provided a first gap G1 having a gap width S1. By the first gap G1, the supporting portion 31 (inserted portion) is allowed to be positionally deviated by a predetermined amount with respect to the inner peripheral surface 82*a* of the insertion hole 82 in an orthogonal direction V orthogonal to the connector connecting direction X.

The annular surface 37 is orthogonal to the connector connecting direction X. The annular surface 37 is disposed with a step being provided with respect to the front surface 81*a* of the wall portion 81 of the device case 80. The annular surface 37 and the front surface 81*a* of the wall portion 81 may, however, be disposed to be flush with each other instead. An annular groove 38, surrounding the first outer peripheral surface 35 is formed in the annular surface 37. The annular groove 38 is defined by a bottom surface 38*a*, an inner wall surface 38*b* at a radially outer side, and an inner wall surface 38*c* at a radially inner side.

As shown in FIG. 4A, the contacts 2 are inserted in contact insertion holes formed in the supporting portion 32 and each has one end 2*a* disposed inside the cylindrical portion 32 and another end 2*b* connected to a conductor portion (not shown) of the circuit board 90.

Figure 6A:
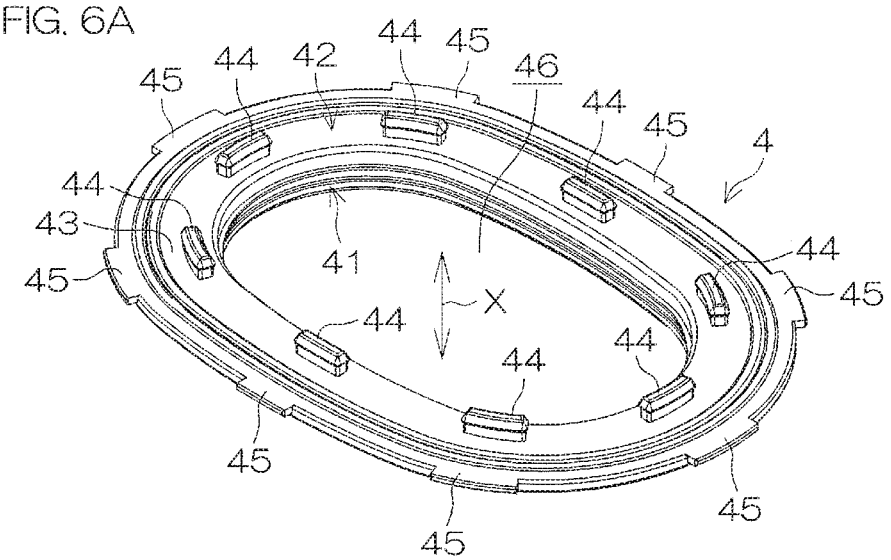
FIG. 6A is a perspective view of a seal member.
Figure 6B:
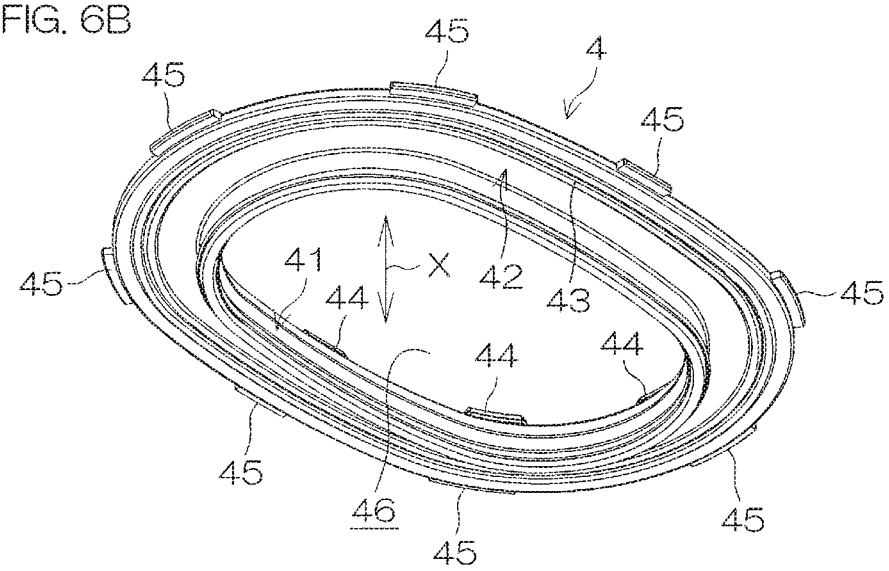
FIG. 6B is a perspective view of the seal member from an angle differing from FIG. 6A.
Figure 7A:
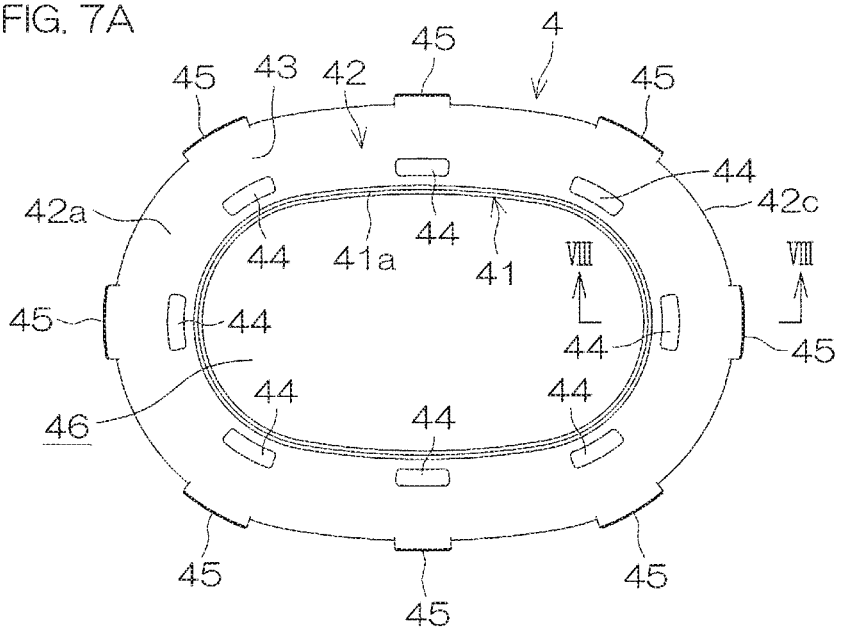
FIG. 7A is a plan view of the seal member.
Figure 7B:
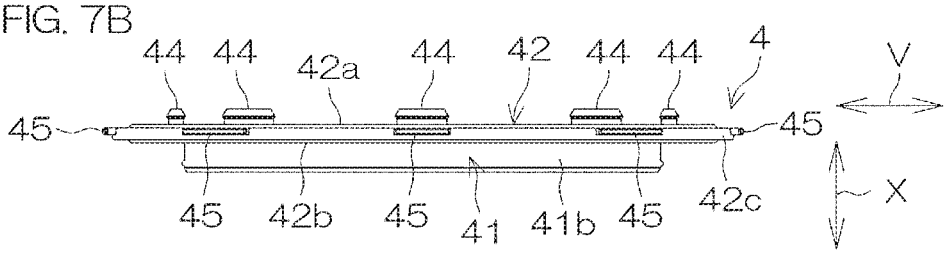
FIG. 7B is a side view of the seal member.
Figure 8:
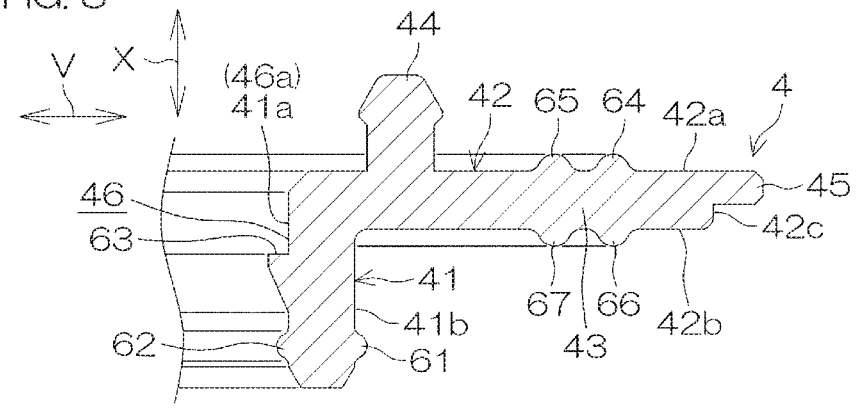
FIG. 8 is a sectional view of the seal member, corresponding to a sectional view taken along VIII-VIII of FIG. 7A.

Next, the seal member 4 will now be described. FIG. 6A and FIG. 6B are perspective views, viewed from mutually different angles, of the seal member 4. FIG. 7A is a plan view of the seal member 4 and FIG. 7B is a front view of the seal member 4. FIG. 8 is a sectional view of the seal member 4 and corresponds to a sectional view taken along VIII-VIII of FIG. 7A.

As shown in FIG. 4B, FIG. 6A, FIG. 6B, FIG. 7A, FIG. 7B, and FIG. 8, the seal member 4 includes a first seal portion 41, a covering portion 42, a second seal portion 43, a plurality of first coupling projections 44, and a plurality of second coupling projections 45. Also, the seal member 4 forms an insertion hole 46 in which the supporting portion 31 (inserted portion) of the housing 3 is inserted.

The first seal portion 41 is a short cylindrical portion fitted in the annular groove 38 and extends in the connector connecting direction X. As shown in FIG. 4B, the covering portion 42 is an annular plate-shaped portion, extending orthogonally toward the front surface 81*a* side of the wall portion 81 from one end of the first seal portion 41 and spanningly covering the first gap G1 between the second outer peripheral surface 36 of the supporting portion 31 and the inner peripheral surface 82*a* of the insertion hole 82.

As shown in FIG. 4B and FIG. 8, the first seal portion 41 includes an inner peripheral surface 41*a*, an outer peripheral surface 41*b*, an outer peripheral seal lip 61, an inner peripheral seal lip 62, and an inner peripheral step portion 63. Chamfered portions 41*c* and 41*d* are formed at an inner side and an outer side of a tip of the first seal portion 41. When inserting the first seal portion 41 into the annular groove 38, the chamfered portions 41*c* and 41*d* serve a function of facilitating the insertion. As a chamfered portion, it suffices that at least one of either of the chamfered portion 41*c* at the inner side and the chamfered portion 41*d* at the outer side is provided.

The inner peripheral surface 41*a* of the first seal portion 41 corresponds to an inner peripheral surface 46*a* of the insertion hole 46 of the seal member 4. The supporting portion 31 (inserted portion) of the housing 3 is inserted in the insertion hole 46 of the seal member 4.

The outer peripheral seal lip 61 is an annular seal lip formed on the outer peripheral surface 41*b*. The outer peripheral seal lip 61 contacts the inner wall surface 38*b* at the outer side of the annular groove 38 in an elastically compressed state. The inner peripheral seal lip 62 is an annular seal lip formed on the inner peripheral surface 41*a*. The inner peripheral seal lip 62 contacts the inner wall surface 38*c* at the radially inner side of the annular groove 38 in an elastically compressed state. The inner peripheral step portion 63 is an annular step portion formed on the inner peripheral surface 41*a*.

As shown in FIG. 4B, the second seal portion 43 faces the seal surface 83*a* of the wall portion 81. The second seal portion 43 is formed by a portion of the covering portion 42 that is sandwiched by the cover member 5 and the seal surface 83*a* of the wall portion 81. The second seal portion 43 provides sealing between the cover member 5 and the seal surface 83*a* of the wall portion 81.

The covering portion 42 includes an annular front surface 42*a*, facing the counterpart connector side, and a rear surface 42*b* that is a surface at an opposite side with respect to the front surface 42*a*. The front surface 42*a* and the rear surface 42*b* of the covering portion 42 are disposed so as to be substantially orthogonal to the connector connecting direction X. The rear surface 42*b* of the covering portion 42 (corresponding to a rear surface of the seal member 4) faces the front surface 81*a* of the wall portion 81 of the device case 80, the annular surface 37 of the supporting portion 31 (inserted portion), and the first gap G1.

As shown in FIG. 4B and FIG. 8, the second seal portion 43 has an outer seal lip 64 and an inner seal lip 65 formed on the front surface 42*a* of the covering portion 42 and contacting the cover member 5. Also, the second seal portion 43 has an outer seal lip 66 and an inner seal lip 67 formed on the rear surface 42*b* of the covering portion 42 and contacting the seal surface 83*a* of the wall portion 81.

As shown in FIG. 4B, the second seal portion 43 contacts the seal surface 83*a* to form an annular seal region A. The annular seal region A is a region between an outer edge of an annular contact region of the outer seal lip 66 with respect to the seal surface 83*a* and an inner edge of an annular contact region of the inner seal lip 67 with respect to the seal surface 83*a*. A seal width S3, which is a radial direction width of the seal region A corresponds to a radial direction width between the outer edge of the annular contact region of the outer seal lip 66 with respect to the seal surface 83*a* and the inner edge of the annular contact region of the inner seal lip 67 with respect to the seal surface 83*a*.

The gap width S1 of the first gap G1 that is the gap between the second outer peripheral surface 36 of the supporting portion 31 (inserted portion) of the housing 3 and the inner peripheral surface 82*a* of the insertion hole 82 of the wall portion 81, the seal width S3 that is the radial direction width of the seal region A of the second seal portion 43, and a radial direction width S4 of the seal surface 83*a* satisfy a relationship of the following inequality (1).

$$S1<(S4-S3)/2 \quad (1)$$

Also, when, as shown in FIG. 3, an outer diameter of each of fixing screws 6, arranged to fasten the cover member 5 to the device case 80, is S7 and a threaded hole diameter of each of the threaded holes 84*a*, in which the fixing screws 6 are inserted, is S8, the gap width S1 of the first gap G1, the outer diameter S7, and the threaded hole diameter S8 satisfy a relationship of the following inequality (2).

$$S1<(S8-S7)/2 \quad (2)$$

As shown in FIG. 6A, the first coupling projections 44 are hook-shaped projections projecting from the front surface 42*a* of the covering portion 42 and are disposed annularly at intervals in a peripheral direction. The second coupling projections 45 are outward projections projecting outward from the outer peripheral surface 42*c* of the covering portion 42 and are disposed at intervals in the peripheral direction. As shown in FIG. 4B, the respective first coupling projections 44 and the respective second coupling projections 45 are respectively coupled to corresponding portions of the cover member 5.

Next, the cover member 5 will now be described. As shown in FIG. 3 and in FIG. 4A and FIG. 4B, the cover member 5 is fixed by the fixing screws 6 to the wall portion 81 of the device case 80 across the covering portion 42 of the seal member 4. The cover member 5 is formed of a resin or a metal.

Figure 9A:
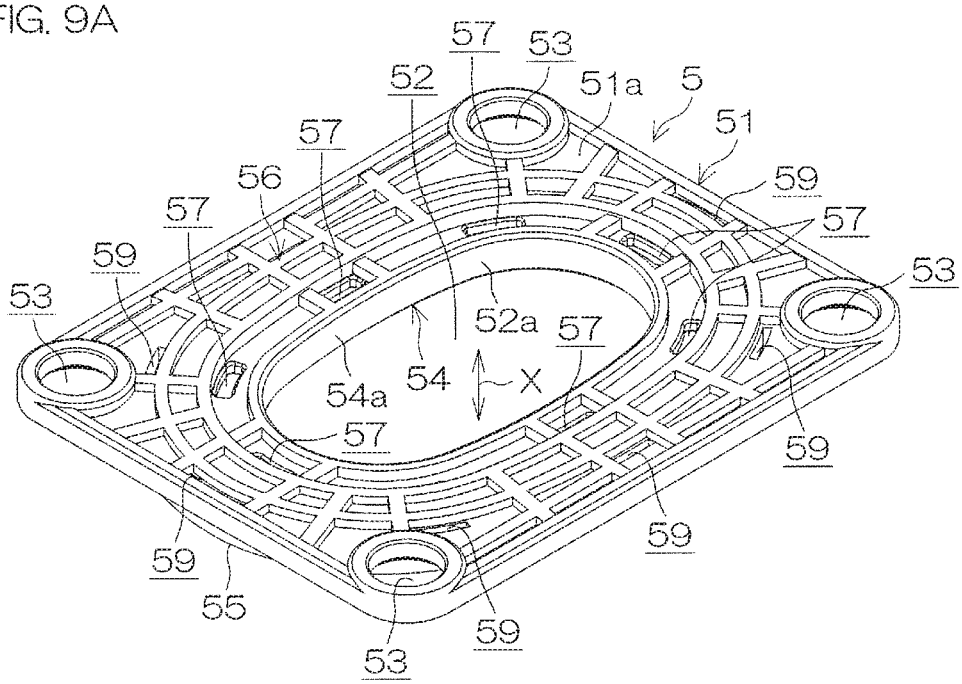
FIG. 9A is a perspective view of a cover member.
Figure 9B:
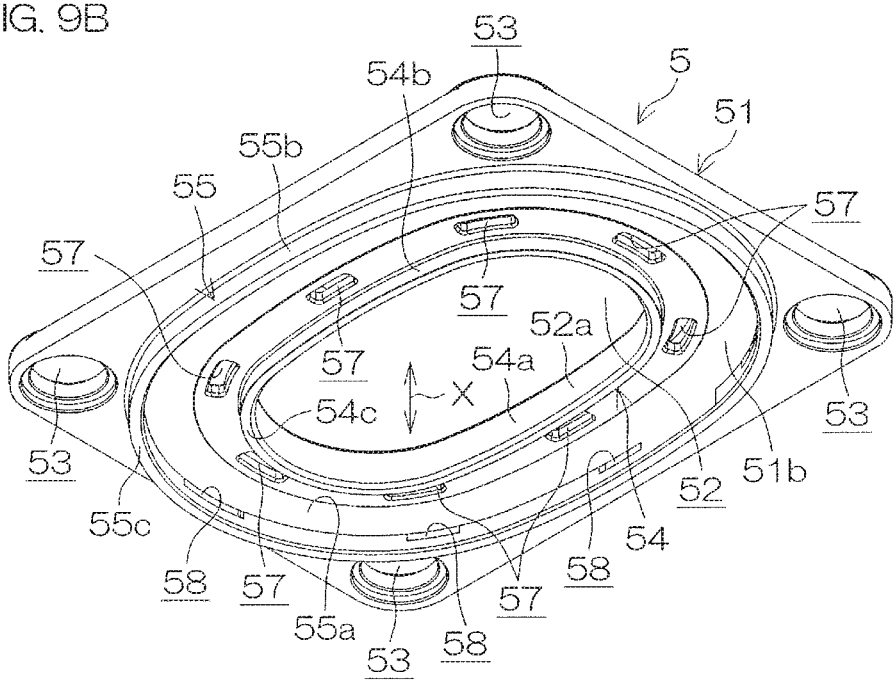
FIG. 9B is a perspective view of the cover member from an angle differing from FIG. 9A.

FIG. 9A and FIG. 9B are perspective views, viewed from mutually different angles, of the cover member 5. As shown in FIG. 4B, FIG. 9A, and FIG. 9B, the cover member 5 includes a main body portion 51, having an insertion hole 52 and a plurality of screw insertion holes 53 formed therein, an inner flange 54 as a holding portion, an outer flange 55, and a rib structure portion 56.

The main body portion 51 has a rectangular plate shape and has a front surface 51*a* and a rear surface 51*b*. The plurality of screw insertion holes 53 are disposed at four corners of the main body portion 51. The supporting portion 31 (see FIG. 4B) of the housing 3 is inserted in the insertion hole 52 of the main body portion 51 that corresponds to an insertion hole of the cover member 5. As shown in FIG. 4B, an inner peripheral surface 52*a* of the insertion hole 52 of the cover member 5 is disposed further radially inward than the inner peripheral surface 46*a* of the insertion hole 46 of the seal member 4. The rear surface 51*b* of the main body portion 51 that corresponds to a rear surface of the cover member 5 faces the front surface 81*a* of the wall portion 81.

The fixing screws 6 are inserted in the screw insertion holes 53 of the main body portion 51 and screwed into the threaded holes 84*a* (see FIG. 3) of the wall portion 81 of the device case 80. The rib structure portion 56 is arranged by combining ribs extending in the peripheral direction and ribs extending in radial directions.

As shown in FIG. 4B, the covering portion 42 (second seal portion 43) of the seal member 4 is clamped between the rear surface 51*b* of the main body portion 51 of the cover member 5 and the front surface 81*a* of the wall portion 81 of the device case 80.

The outer seal lip 64 and the inner seal lip 65 of the front surface 42*a* of the covering portion 42 of the seal member 4 contact the rear surface 51*b* of the main body portion 51 of the cover member 5 in elastically compressed states. The outer seal lip 66 and the inner seal lip 67 of the rear surface 42*b* of the covering portion 42 of the seal member 4 contact the seal surface 83*a* of the wall portion 81 of the device case 80 in elastically compressed states.

The inner flange 54 and the outer flange 55 are annular flanges formed to project from the rear surface 51*b* of the main body portion 51. The outer flange 55 is disposed to be separated to an outer side of the inner flange 54. The annular outer flange 55 of the cover member 5 surrounds a radial outer side of the boss portion 83 of the wall portion 81.

When, as shown in FIG. 4B, a distance from the front surface 81*a* of the wall portion 81 to the flat seal surface 83*a* is H1 and a distance from the front surface 81*a* of the wall portion 81 to the outer flange 55 is H2, the distance H1 and the distance satisfy a relationship of the following inequality (3).

$$H1>H2 \quad (3)$$

As shown in FIG. 4B, FIG. 9A, and FIG. 9B, a plurality of fitting holes 57, in which the respective hook-shaped first coupling projections 44 of the seal member 4 are respectively fitted, are formed in a portion of the main body portion 51 between the inner flange 54 and the outer flange 55. The fitting holes 57 penetrate through the main body portion 51 in the connector connecting direction X.

As shown in FIG. 4B and FIG. 9B, the outer flange 55 has an inner peripheral surface 55*a*, an outer peripheral surface 55*b*, and an end surface 55*c*. Fitting holes 58, in which the respective second coupling projections 45 of the seal member 4 are fitted, are formed in the inner peripheral surface 55*a* of the outer flange 55. The fitting holes 58 are bottomed holes having depth in the orthogonal direction V orthogonal to the connector connecting direction X.

As shown in FIG. 4B and FIG. 9A, visual recognition holes 59, opening at the front surface 51*a* and communicating orthogonally with the fitting holes 58, are formed in the main body portion 51. The visual recognition holes 59 are holes for visually checking whether the second coupling projections 45 of the seal member 4 are fitted in the fitting holes 58 of the cover member 5. During assembly of the unit U, an installation fault of the seal member 4 with respect to the cover member 5 can be suppressed by visually checking through the visual recognition holes 59.

As shown in FIG. 4B, the covering portion 42 of the seal member 4 is firmly coupled to the cover member 5 by the respective coupling projections 44 and 45 of the seal member 4 being fitted in the corresponding fitting holes 57 and 58 of the cover member 5. In particular, the first coupling projections 44 of the seal member 4 are formed to the hook shape and are therefore unlikely to become detached from the fitting holes 57 of the cover member 5.

Also, the second coupling projections 45, fitted in the fitting holes 58, are outward projections provided on the outer peripheral surface 42*c* of the covering portion 42 of the seal member 4 and extend in the orthogonal direction V orthogonal to the connector connecting direction X. The rear surface 51*b* of the main body portion 51 of the cover member 5 and the front surface 42*a* of the covering portion 42 of the seal member 4 are thus effectively suppressed from separating in the connector connecting direction X by the second coupling projections 45.

As shown in FIG. 4B and FIG. 9B, the inner flange 54 has an inner peripheral surface 54*a*, an outer peripheral surface 54*b*, and an end surface 54*c*. The inner peripheral surface 54*a* of the inner flange 54 extends continuously from the inner peripheral surface 52*a* of the insertion hole 52. A second gap G2, having a gap width S2, is provided between the first outer peripheral surface 35 of the supporting portion 31 and the inner peripheral surface 52*a* of the insertion hole 52 of the cover member 5 and inner peripheral surface 54*a* of the inner flange 54.

When, as shown in FIG. 4B, a width resulting from subtracting a chamfer width of the chamfered portions 41*c* and 41*d* from a thickness width between the inner peripheral surface 41*a* and the outer peripheral surface 41*b* of the first seal portion 41 is S5 and a width of the annular groove 38 is S6, the gap width S2 of the second gap G2, the width S5, and the width S6 satisfy a relationship of the following inequality (4).

$$S2<(S6-S5)/2 \quad (4)$$

As shown in FIG. 4B, the outer peripheral surface 54*b* of the inner flange 54 of the cover member 5 is arranged substantially along the inner peripheral surface 41*a* of the first seal portion 41 of the seal member 4, and the end surface 54*c* of the inner flange 54 is arranged substantially along the inner peripheral step portion 63 of the inner peripheral surface 41*a* of the first seal portion 41 of the seal portion 4. A labyrinth gap LC1, suppressing entry of water from the exterior, is thereby formed between the inner flange 54 of the cover member 5 and the first seal portion 41 of the seal member 4. The inner flange 54 of the cover member 5 functions as a holding portion holding the first seal portion 41 and, during assembly, functions to facilitate the insertion of the first seal portion 41 into the annular groove 38.

According to the present preferred embodiment, the seal member 4 has the first seal portion 41 and the second seal portion 43 and therefore, in comparison to a case where the respective seal portions are constituted of separate members, a work of installing the seal member 4 during assembly is easy and ease of assembly is satisfactory. Also, even if the gap width S1 of the first gap G1 between the inner peripheral surface 82*a* of the insertion hole 82 of the wall portion 81 and the second outer peripheral surface 36 of the supporting portion 31 (inserted portion) of the housing 3 changes due to variations in installation precisions of components, this does not influence a sealing performance by the covering portion 42 that spanningly covers the first gap G1. Excellent waterproofness can thus be obtained.

Even if a relative position of the wall portion 81 and the supporting portion 31 (inserted portion) of the housing 3 in the connector connecting direction X varies, the variation is absorbed by changing of an insertion amount of the first seal portion 41 in the annular groove 38. Also, even if the relative position of the wall portion 81 and the supporting portion 31 (inserted portion) of the housing 3 in the orthogonal direction Y varies, the variation is absorbed by displacement of the covering portion 42, including the second seal portion 43, in the orthogonal direction V with respect to the wall portion 81. Excellent waterproofness can thus be secured regardless of the above positional variations.

Also, the seal member 4 and the cover member 5, which is harder than the seal member 4, can be handled integrally as the single unit U. Therefore, during assembly, installation is facilitated and the ease of assembly is improved in comparison to a case where the seal member 4 is installed as a single body.

Also, in the unit U that includes the seal member 4 and the cover member 5, the first seal portion 41 of the seal member 4 is held by the inner flange 54 (holding portion) of the cover member 5. It is thus easy to insert the first seal portion 41 in the annular groove 38 when installing the unit U and the ease of assembly is more improved.

Also, the labyrinth gap LC1 is formed between the first seal portion 41 of the seal member 4 and the inner flange 54 of the cover member 5. Moisture, etc., from the exterior can thus be suppressed from entering through between the cover member 5 and the seal member 4.

Also, the gap width S1 of the first gap G1, the seal width S3 of the seal region of the second seal portion 43, and the radial direction width S4 of the seal surface 83*a* satisfy the relationship of S1<(S4−S3)/2 and therefore, even if a deviation of a relative position of the device case 80 and the waterproof connector 1 is large, excellent waterproofness can be secured regardless of a deviation amount of the relative position.

Also, excellent waterproofness can be secured because the inner peripheral surface 52*a* of the insertion hole 52 of the cover member 5 is disposed further radially inward than the inner wall surface 38*c* at the radially inner side of the annular groove 38, which is provided in the housing 3 and in which the first seal portion 41 is fitted, and the structure is such that the first seal portion 41 is not wetted directly even when high pressure water is applied to the waterproof connector 1.

Also, the distance H1 from the front surface 81*a* of the wall portion 81 to the flat seal surface 83*a* and the distance H2 from the front surface 81*a* of the wall portion 81 to the outer flange 55 of the cover member 5 satisfy the relationship of H1>H2. The seal surface 82*a* is thus not wetted directly even when high pressure water is applied to the waterproof connector 1 and therefore excellent waterproofness can be secured.

If the wall portion 81 is an aluminum die-cast component, the front surface 81*a* of the wall portion 81 may corrode when it is wetted with salt water. On the other hand, with the present preferred embodiment, the structure is such that salt water would not be applied directly to the flat seal surface 83*a*. Also, the structure is such that the seal surface 83*a* is positioned one step higher from the front surface 81*a* of the wall portion 81 and salt water can be prevented from flowing into the seal surface 83*a* side. Excellent salt water resistance can thus be secured.

Also, the gap width S2 of the second gap G2, which is the gap between the first outer peripheral surface 35 of the supporting portion 31 (inserted portion) and the inner peripheral surface 52*a* of the insertion hole 52 of the cover member 5, the width S5 resulting from subtracting the chamfer width of the chamfered portions 41*c* and 41*d* from the thickness width between the inner peripheral surface 41*a* and the outer peripheral surface 41*b* of the first seal portion 41, and the width S6 of the annular groove 38 satisfy the relationship of S2<(S6−S5)/2.

The following effect is thus exhibited. That is, when installing the unit U, with which the cover member 5 and the seal member 4 are assembled together in advance, onto the waterproof connector 1 and the device case 80, the inner peripheral surface 52*a* of the insertion hole 52 of the cover member 5 is guided by the outer peripheral surface (first outer peripheral surface 35) of the supporting portion 31 (inserted portion) of the waterproof connector 1. That is, the first seal portion 41 can be inserted in the annular groove 38 in a state where the tip of the first seal portion 41 is in alignment with the annular groove 38, thus improving ease of assembly and enabling reduction of assembly cost. Consequently, adaptation to automatic assembly is enabled and further reduction of the assembly cost is enabled.

Also, the gap width S1 of the first gap G1, the outer diameter S7 of the fixing screws 6 arranged to fasten the cover member 5 to the device case 80, and the threaded hole diameter S8 of the threaded holes 84*a* satisfy the relationship of S1<(S8−S7)/2. Therefore, even if the deviation of the relative position of the device case 80 and the waterproof connector 1 is large, excellent waterproofness can be secured regardless of the deviation amount of the relative position because the cover member 5 and the seal member 4 move.

Also, the waterproof structure 10 that is satisfactory in ease of assembly and has excellent waterproofness can be realized.

Second Preferred Embodiment

Figure 10A:
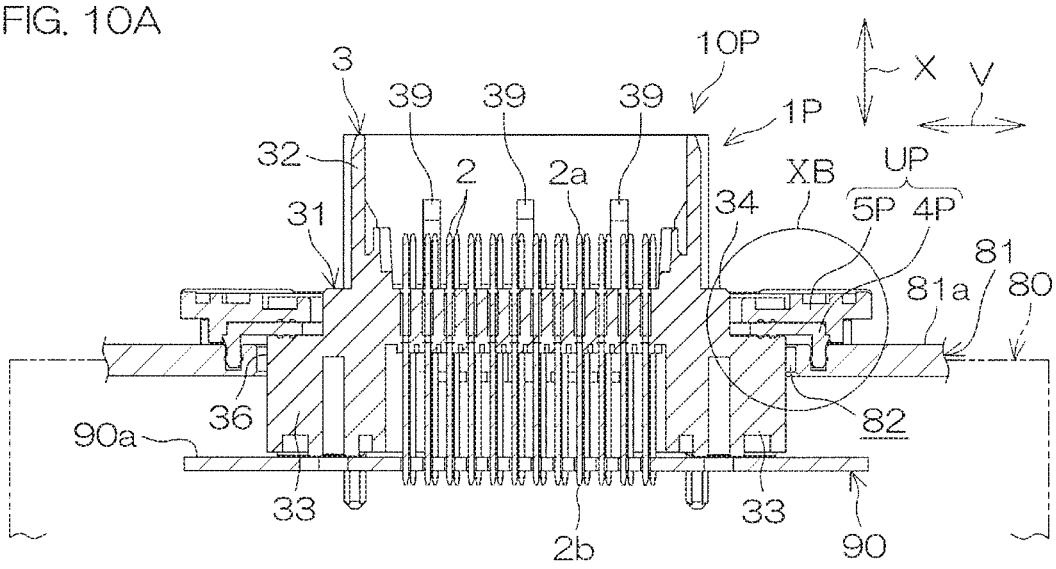
FIG. 10A is a general sectional view of a waterproof structure of a device case that includes a waterproof connector according to a second preferred embodiment of the present invention.
Figure 10B:
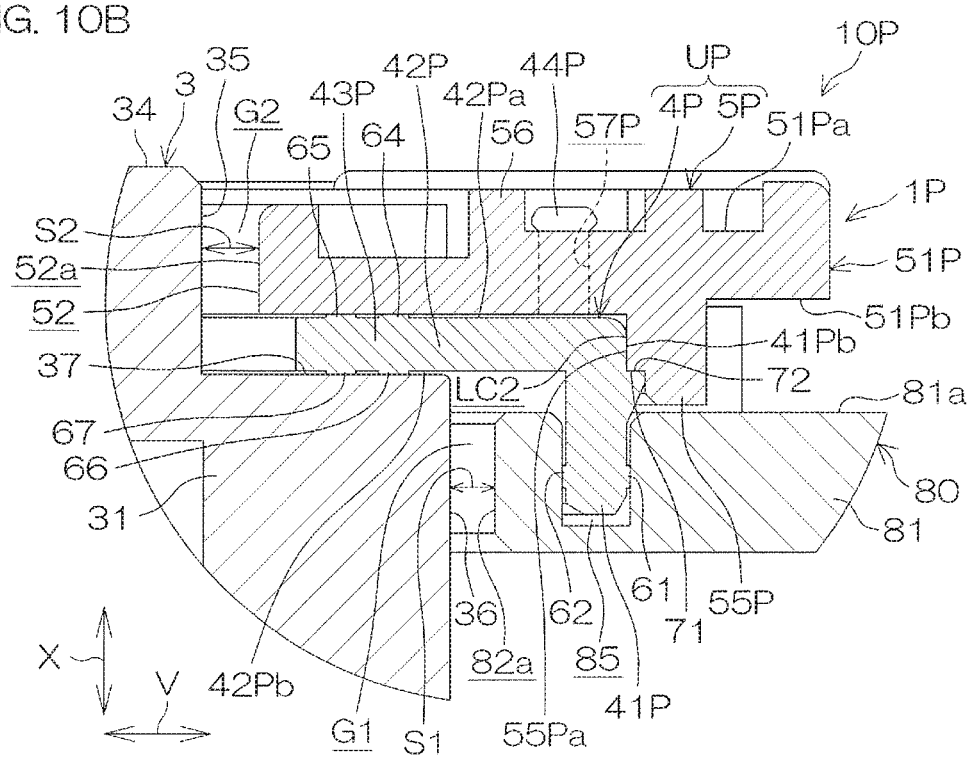
FIG. 10B is an enlarged sectional view enlarging an XB portion of FIG. 10A.

FIG. 10A is a general sectional view of a waterproof structure 10P of a device case that includes a waterproof connector 1P according to a second preferred embodiment of the present invention. FIG. 10B is an enlarged sectional view enlarging an XB portion of FIG. 10A. The waterproof connector 1P of the second preferred embodiment of FIG. 10A and FIG. 10B mainly differs as follows from the waterproof connector 1 of the first preferred embodiment of FIG. 4A and FIG. 4B.

An annular groove 85 is formed in the front surface 81*a* of the wall portion 81. An integrally handleable single unit UP is constituted of a seal member 4P and a cover member 5P. The seal member 4P includes a first seal portion 41P, a covering portion 42P, having a second seal portion 43P, and coupling projections 44P. The first seal portion 41P is fitted in the annular groove 85 of the front surface 81*a* of the wall portion 81. The covering portion 42P extends orthogonally from the first seal portion 41P toward the annular surface 37 side of the supporting portion 31 (inserted portion).

The cover member 5P includes a main body portion 51P, a flange 55P as a holding portion projecting from a rear surface 51Pb of the main body portion 51P, and the rib structure portion 56 provided on a front surface 51Pa of the main body portion 51P. The main body portion 51P of the cover member 5P is fixed using fixing screws (not shown) to the annular surface 37 of the supporting portion 31 (inserted portion). The cover member 5P, together with the annular surface 37, sandwiches the covering portion 42P of the seal member 4P. The second seal portion 43P is formed by a portion of the covering portion 42P of the seal member 4P that is sandwiched by the cover member 5 and the annular surface 37.

The flange 55P is arranged substantially along an outer peripheral surface 41Pb of the first seal portion 41P and functions as a holding portion holding the first seal portion 41P. An inner peripheral surface 55Pa of the flange 55P of the cover member 5P is arranged substantially along the outer peripheral surface 41Pb of the first seal portion 41P. Also, an inner peripheral step portion 71, formed on the inner peripheral surface 55Pa of the flange 55P, and an outer peripheral step portion 72, formed on the outer peripheral surface 41Pb of the first seal portion 41P, are arranged substantially along each other. A labyrinth gap LC2 is thereby formed between the flange 55P of the cover member 5P and the first seal portion 41P of the seal member 4P.

Also, the first outer peripheral surface 35 of the supporting portion 31 (inserted portion) faces the inner peripheral surface 52*a* of the insertion hole 52 of the cover member 5P across the second gap G2 having the gap width S2. The second outer peripheral surface 36 of the supporting portion 31 faces the inner peripheral surface 82*a* of the insertion hole 82 of the wall portion 81 across the first gap G1 having the gap width S1. By the second gap G2, the supporting portion 31 (inserted portion) of the housing 3 is allowed to be positionally deviated by a predetermined amount with respect to the cover member 5P, fixed to the wall portion 81 of the device case 80, in the orthogonal direction V orthogonal to the connector connecting direction X. The gap width S1 of the first gap G1 and the gap width S2 of the second gap G2 satisfy a relationship of S1<S2.

Components, among the components in FIG. 10A and FIG. 10B, that are the same as the components in FIG. 4A and FIG. 4B are provided with reference symbols in common or are provided with reference symbols in common with a suffix P added thereto.

According to the present preferred embodiment, the seal member 4P has the first seal portion 41P and the second seal portion 43P and therefore, in comparison to a case where the respective seal portions are constituted of separate members, a work of installing the seal member 4P during assembly is easy and ease of assembly is satisfactory. Also, even if the gap width S1 of the first gap G1 between the inner peripheral surface 82*a* of the insertion hole 82 of the wall portion 81 and the second outer peripheral surface 36 of the supporting portion 31 (inserted portion) of the housing 3 changes, this does not influence a sealing performance by the covering portion 42P that spanningly covers the first gap G1. Excellent waterproofness can thus be obtained.

Also, the seal member 4P and the cover member 5P, which is harder than the seal member 4P, are formed to the integrally handleable single unit UP and therefore ease of assembly is improved.

Also, the gap width S2 of the second gap G1 is made greater than the gap width S1 of the first gap G1 (S1<S2). The cover member 5P, fixed to the wall portion 81 of the device case 80, thus does not restrict a deviation amount of a relative position of the device case 80 and the supporting portion 31 (inserted portion) of the housing 3. Consequently, even when the deviation of the relative position of the device case 80 and the waterproof connector 1 is large, excellent waterproofness can be secured regardless of the deviation amount of the relative position.

Also, in the unit UP, the first seal portion 41P of the seal member 4P is held by the flange 55P (holding portion) of the cover member 5P. It is thus made easy to insert the first seal portion 41P in the annular groove 85 of the wall portion 81 when installing the unit UP and the ease of assembly is more improved.

Also, the labyrinth gap LC2 is formed between the first seal portion 41P of the seal member 4P and the flange 55P of the cover member 5P. Moisture, etc., from the exterior can thus be suppressed from entering through between the cover member 5P and the seal member 4P.

Also, the waterproof structure 10P that is satisfactory in ease of assembly and has excellent waterproofness can be realized.

The present invention is not restricted to the respective preferred embodiments described above and, for example, the inserted portion is not restricted to the supporting portion 31 and suffices to be constituted of an annular portion (not shown) projecting further outward than the cylindrical portion 32 in the housing 3. Also, the seal member 4 or 4P and the cover member 5 or 5P that constitutes the unit U may be formed by two color molding.

Also, the seal member 4 or 4P and the cover member 5 or 5P may be installed successively instead of being arranged in the unit U or UP. Also, as a structure besides the fixing screws 6 for fixing the cover member 5 or 5P to the wall portion 81 or the supporting portion 31 (inserted portion), a known lock structure or other fixing structure may be adopted.

The present invention has been described in detail above by way of specific embodiments, and a person skilled in the art who has understood the above contents can readily conceive of changes, modifications, and equivalents thereof. The present invention shall thus be deemed to cover the scope of the claims and the scope of the equivalents of the claims.

REFERENCE SIGNS LIST

1; 1P: Waterproof connector
2: Contact
3: Housing
4; 4P: Seal member
5; 5P: Cover member
10; 10P: Waterproof structure (of device case)
31: Supporting portion (inserted portion)
36: Second outer peripheral surface
37: Annular surface
38: Annular groove
41; 41P: First seal portion
41*c*; 41*d*: Chamfered portion
42; 42P: Covering portion
43; 43P: Second seal portion
46: Insertion hole
46*a*: Inner peripheral surface
51; 51P: Main body portion
52: Insertion hole
52*a*: Inner peripheral surface
54: Inner flange (holding portion)
55P: Flange (holding portion)
80: Device case
81: Wall portion
81*a*: Front surface
82: Insertion hole
82*a*: Inner peripheral surface
85: Annular groove
90: Circuit board
90*a*: Mounting surface
A: Seal region
G1: First gap
G2: Second gap
H1, H2: Distance
LC1; LC2: Labyrinth gap
S1, S2: Gap width
S3: Seal width (of second seal portion)
S4: Radial direction width (of seal surface)
S5, S6: Width
S7: Outer diameter (of fixing screw)
S8: Threaded hole diameter
U; UP: Unit
V: Orthogonal direction (orthogonal to connector connecting direction)
X: Connector connecting direction

What is claimed is:

1. A waterproof connector, mounted on a surface of a circuit board, which is fixed inside a device case that includes a wall portion with an insertion hole formed therein, and connected to a counterpart connector via the insertion hole in a connector connecting direction orthogonal to a surface of the wall portion and comprising:

a contact electrically connected to the counterpart connector;

an insulating housing including an inserted portion holding the contact and inserted in the insertion hole, the inserted portion including an annular surface disposed flush to or with a step provided with respect to the surface of the wall portion;

an elastic seal member including an annular first seal portion fitted in an annular groove formed in either one of the annular surface of the inserted portion and the front surface of the wall portion, and an annular covering portion extending orthogonally from the first seal portion toward the other one of the annular surface of the inserted portion and the surface of the wall portion and spanningly covering a gap between an outer peripheral surface of the inserted portion and an inner peripheral surface of the insertion hole and having a second seal portion; and a cover member fixed to the other one and sandwiching, together with the other one, the covering portion of the seal member; and wherein the second seal portion is formed by a portion of the covering portion of the seal member that is sandwiched by the cover member and the other one.

2. The waterproof connector according to claim 1, wherein the cover member is harder than the seal member and a single unit that includes the seal member and the cover member is formed.

3. The waterproof connector according to claim 2, wherein the cover member includes a main body portion coupled to the covering portion, and a holding portion extended from the main body portion and holding the first seal portion.

4. The waterproof connector according to claim 1, wherein a labyrinth gap is formed between the seal member and the cover member.

5. The waterproof connector according to claim 1, wherein an annular seal surface facing the second seal portion is formed on the surface of the wall portion, the second seal portion contacts the seal surface to form an annular seal region, and when a gap width of the gap between the outer peripheral surface of the inserted portion and the inner peripheral surface of the insertion hole is S1, a seal width that is a radial direction width of the seal region of the second seal portion is S3, and a radial direction width of the seal surface is S4, such a relationship that S1<(S4−S3)/2 is established.

6. The waterproof connector according to claim 1, wherein an insertion hole in which the inserted portion of the housing inserted is formed in the cover member, and an inner peripheral surface of the insertion hole of the cover member is disposed further radially inward than an inner wall surface at a radially inner side of the annular groove which is provided in the housing and in which the first seal portion is fitted.

7. The waterproof connector according to claim 1, wherein on the surface of the wall portion, a boss portion having a flat seal surface facing the second seal portion, at an end surface, is formed along a peripheral edge of the insertion hole of the wall portion, the cover member includes a rear surface facing the surface of the wall portion, and an annular outer flange projecting from the rear surface and surrounding a radial outer side of the boss portion, and when a distance from the surface of the wall portion to the seal surface is H1 and a distance from the surface of the wall portion to the outer flange is H2, such a relationship that H1>H2 is established.

8. The waterproof connector according to claim 1, wherein the annular groove is formed in the annular surface of the housing, the outer peripheral surface of the inserted portion of the housing includes a first outer peripheral surface facing an inner peripheral surface of an insertion hole formed in the cover member across a gap with a gap width S2, a chamfered portion is provided at least on one of either of an inner side and an outer side of a tip of the first seal portion, and when a width resulting from subtracting a chamfer width of the chamfered portion from a thickness width between an inner peripheral surface and an outer peripheral surface of the first seal portion is S5 and a width of the annular groove is S6, such a relationship that S2<(S6−S5)/2 is established.

9. The waterproof connector according to claim 8, wherein the outer peripheral surface of the inserted portion of the housing includes a second outer peripheral surface facing the inner peripheral surface of the insertion hole of the wall portion across a gap with a gap width S1, and when an outer diameter of a fixing screw arranged to fasten the cover member to the device case is S7 and a threaded hole diameter of a threaded hole, in which the fixing screw is inserted, is S8, such a relationship that S1<(S8−S7)/2 is established.

10. The waterproof connector according to claim 1, wherein the annular groove is formed in the front surface of the wall portion, the outer peripheral surface of the inserted portion of the housing includes a first outer peripheral surface facing an inner peripheral surface of an insertion hole formed in the cover member across a second gap, and a second outer peripheral surface facing the inner peripheral surface of the insertion hole of the wall portion across a first gap, and when a gap width of the first gap is S1 and a gap width of the second gap is S2, such a relationship that S1<S2 is established.

11. A waterproof structure of a device case including the device case which includes a wall portion with an insertion hole formed therein and to which a circuit board is fixed, and the waterproof connector according to claim 1.

* * * * *